US005570947A

United States Patent [19]

Felland

[11] Patent Number: 5,570,947

[45] Date of Patent: Nov. 5, 1996

[54] LIGHT FIXTURE

[76] Inventor: Garold M. Felland, 4550 Minnetonka Blvd., St. Louis Park, Minn. 55416

[21] Appl. No.: 336,304

[22] Filed: Nov. 8, 1994

[51] Int. Cl.[6] ..... F21V 15/00; F21V 7/00

[52] U.S. Cl. ..... 362/148; 362/225; 362/260; 362/346; 362/364

[58] Field of Search ..... 362/148, 225, 362/249, 260, 298, 346, 347, 404, 364, 221, 217

[56] References Cited

U.S. PATENT DOCUMENTS

| | | | |
|---|---|---|---|
| 3,246,138 | 4/1966 | Florence | 362/217 |
| 3,363,093 | 1/1968 | Schmitt | 362/347 |
| 4,514,793 | 4/1985 | Andreasen | 362/347 |
| 4,729,075 | 3/1988 | Brass | 362/217 |

FOREIGN PATENT DOCUMENTS

| | | | |
|---|---|---|---|
| 867323 | 5/1961 | United Kingdom | 362/221 |

OTHER PUBLICATIONS 3M brochure entitled "Silverlux Reflectors Cut Your Lighting Energy Costs in Half." 4 pages photocopied.

*Primary Examiner*—Denise L. Gromada
*Assistant Examiner*—Sara Sachie Raab
*Attorney, Agent, or Firm*—Palmatier, Sjoquist & Helget, P.A.

[57] ABSTRACT

Disclosed is a ceiling light fixture suitable for conventional fluorescent lamps. The fixture has an elongate shroud with a modified elliptical cross-section having an inverted apical crease and a downwardly facing specular reflective surface. A rigid raceway extends lengthwise within the shroud and is secured to two rigid opposing end panels which support the shroud. The raceway is substantially at the ceiling level, encloses the ballast, and provides an infrastructure for the fixture.

15 Claims, 3 Drawing Sheets

LIGHT FIXTURE

BACKGROUND OF THE INVENTION

This invention relates to lighting fixtures. More particularly it relates to lighting fixtures for use in overhead lighting.

Existing light fixtures for overhead lighting in commercial and retail applications typically use fluorescent lamps for a number of reasons relating to maintenance, energy efficiency and lighting capabilities. In all of these areas, fluorescent lights have advantages over incandescent lights. In such retail and commercial applications the ceiling is typically of a suspended ceiling configuration using suspended T-bars arranged in a gridwork for hanging ceiling panels. Light fixtures for use in such ceilings are typically sized to fit within the gridwork of the T-bars. A typical suspended ceiling will have grids formed by the suspended T-bars with each grid section being two foot by four foot. Conventional fluorescent light fixtures are typically sized to fit within such grids. Such traditional fixtures usually have a box shaped housing with a separate upper chamber that contains the ballast and wiring. The chamber is typically substantially the same length and width as the fixture. Due to the general box shape configuration of conventional fixtures the chamber is greatly oversized at least insofar as what is required for containing the ballast.

The fluorescent lamps are typically mounted within the fixtures below the chamber housing the ballast. Typically a transparent plastic panel or louvers will be mounted on the open bottom end of said fixtures, positioned between the bulbs and the space to be lit. Such louvers or transparent panels function to temper the intensity of the light emitting from the fluorescent tubes when looking directly at the fixture. Such louvers or transparent panels also necessarily decrease the efficiency of the light transmission of the fixtures.

The typical fluorescent ceiling light fixture utilizes four fluorescent lamps placed in a parallel arrangement in a horizontal plane within the fixture. Such conventional fixtures also typically utilize a painted white panel for a reflector immediately above the fluorescent tubes. Said panel may also be the bottom panel for the chamber containing the ballast.

Due to the size and weight of said light fixtures, it is typically a two-man operation to place the light fixtures in the suspended ceiling grid. Moreover, the location of the relatively heavy ballast at the top of the box structure creates a high center of gravity lending towards awkwardness in handling these structures.

SUMMARY OF THE INVENTION

Disclosed is a ceiling light fixture suitable for conventional fluorescent lamps. The fixture has an elongate shroud with a modified elliptical cross-section having an inverted apical crease and a downwardly facing specular reflective surface. A rigid raceway extends lengthwise within the shroud and is secured to two rigid opposing end panels which support the shroud. The raceway is substantially at the ceiling level, encloses the ballast, and provides an infrastructure for the fixture. The fluorescent lamps are positioned above the raceway and below the reflective surface whereby they are substantially hidden from direct view from immediately below the fixture.

The light fixture utilizes a unique structural configuration to provide improved lighting capabilities with less size and weight compared to prior art fixtures. The light fixture constructed in conformance with the preferred embodiment, having three fluorescent lamps, provides comparable lighting capabilities as conventional four lamp fixtures and is approximately half the size and weight. Consequently, the three fluorescent lamp embodiment generally requires only one person to install as compared to two persons for the conventional four lamp fixture.

An additional feature of the invention is that the shroud functions as the exterior housing of the fixture and provides the reflective surface for the lamps. This dual functioning minimizes the number of components, the amount of materials and fabrication needed to construct the device, and correspondingly reduces the weight.

An additional advantage and feature of the invention is that the raceway provides the infrastructure for the fixture and the rigid end panels support the shroud which allows the use of less rigid and therefore lighter material for the shroud.

An additional feature and advantage of the invention is that the positioning of the ballast in the lower raceway provides for optimal use of space, minimizes the size of the fixture, and provides a lower center of gravity allowing easier handling especially during installation.

An additional feature and advantage of the invention is that the fixture can provide better concentration of light than the conventional form of lamp fixtures on areas directly below the fixture.

A feature of a preferred embodiment of the invention is that the device may optimally utilize modern energy efficient lamps and ballasts.

An additional feature of the invention is that the raceway provides a convenient area on the fixture to grasp and utilize during installation of the fixture in the ceiling grid.

A feature and advantage of the preferred embodiment of the light fixture is the modified elliptically shaped shroud with the inverted apical crease provides improved structural integrity and improved light distribution characteristics. Moreover, the inverted apical crease reduces the height of the fixture.

An additional feature and advantage of the preferred embodiment of the invention is that the fluorescent lamps may be replaced without removal of louvers, translucent panels, or other parts, and without any disassembly of the fixture. Moreover, the reflective surface may also be cleaned without removal of louvers or translucent panels.

The unique configuration provides optimal structural integrity and optimal lighting capabilities with a minimal amount of materials and weight.

DETAILED DESCRIPTION OF THE PREFERRED EMBODIMENTS

Figure 1:
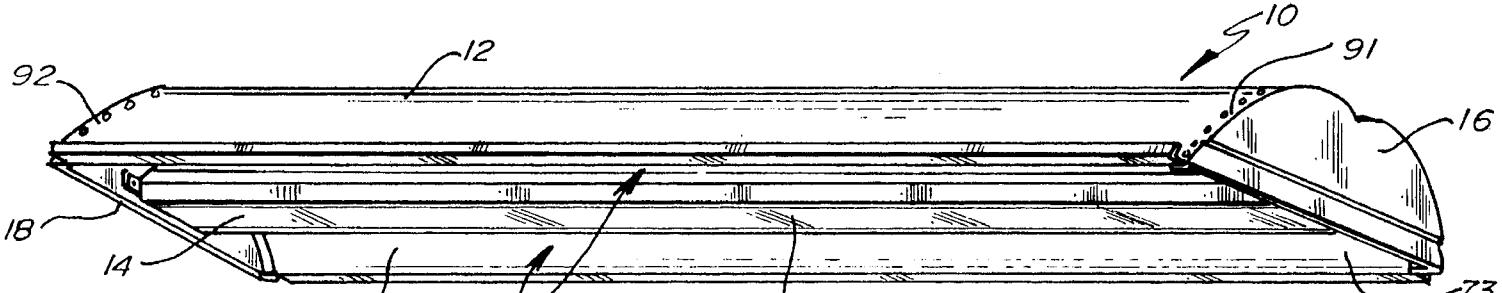
FIG. 1 shows a perspective view of the light fixture.
Figure 2:
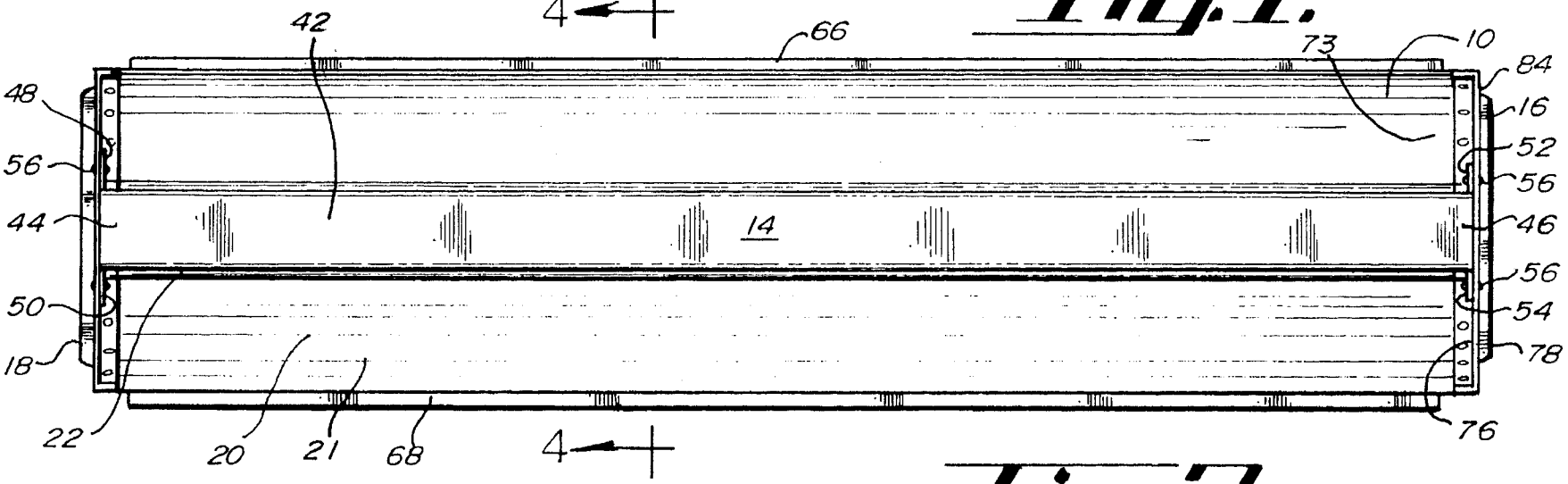
FIG. 2 shows a bottom plan view of the light fixture.

Referring to FIGS. 1 and 2, a perspective view and a bottom plan view of the invention are shown with the invention generally designated by the numeral 10. The invention is principally comprised of a shroud 12, a raceway 14 which forms an infrastructure for the apparatus, and a pair of end portions or panels 16, 18 which connect between the raceway 14 and shroud 12. The shroud 12 and the apparatus 10 have an open interior 20 into which are placed illuminated tubes between the shroud 12 and the raceway 14. The light is transmitted out the open bottom 21 of the fixture.

Figure 3:
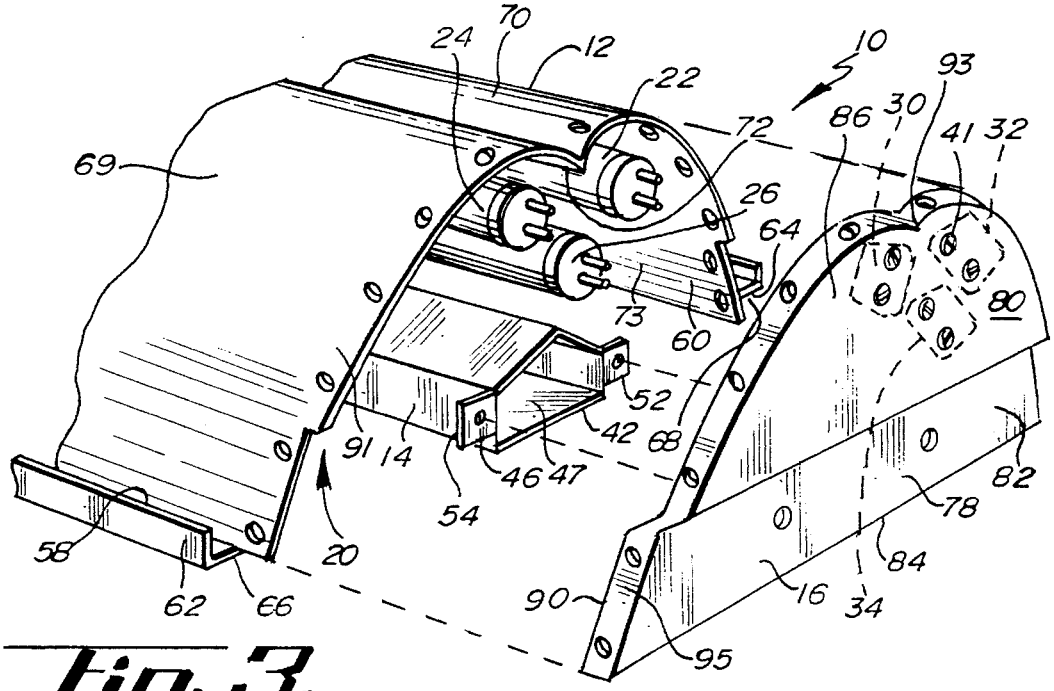
FIG. 3 shows an exploded view of one end of the light fixture.
Figure 4:
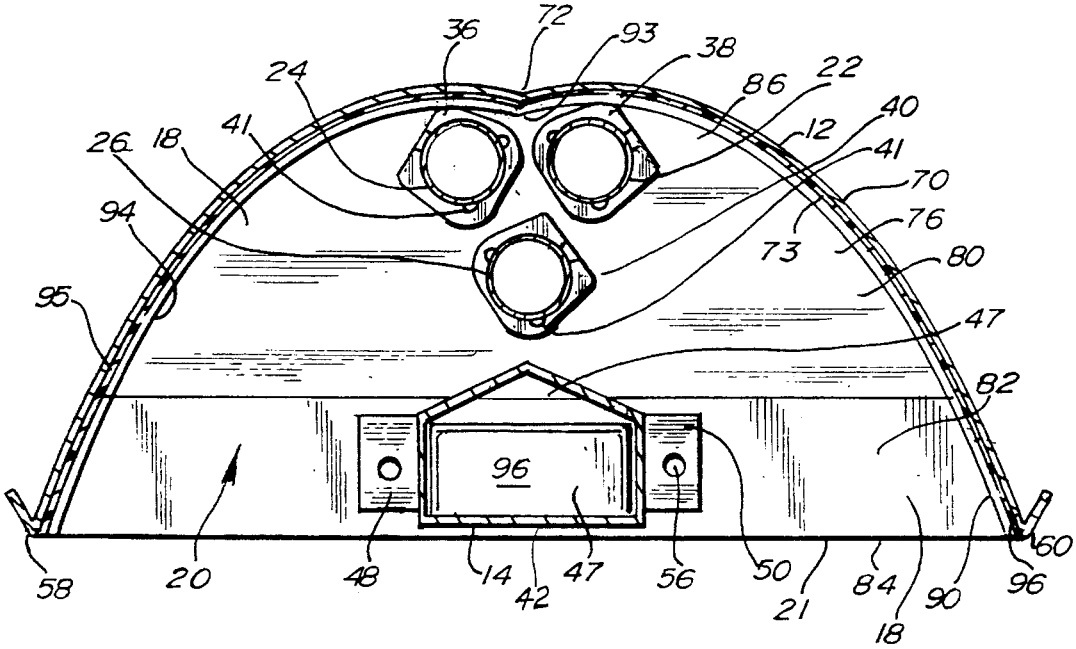
FIG. 4 shows a cross-sectional view of the apparatus taken at line 4—4 of FIG. 2.

Referring to FIGS. 3 and 4, an exploded view and a sectional view of the invention 10 are shown revealing suitable placement of the illuminated tubes which are shown as fluorescent lamps 22, 24, 26. The lamps are attached to the fixture 10 by way of sockets or connectors 30, 32, 34, 36, 38, 40 which may be suitably attached to the end portions 16, 18 such as by rivets, screws 41 or other conventional fastening means. The sockets 30, 32, 34, 36, 38, 40 are located on the end portions so as to position the lamps 22, 24, 26 substantially over the raceway 14 so that the lamps are, for the most part, not directly visible from directly below the fixture 10.

Referring to FIGS. 2, 3 and 4, the raceway or infrastructure 14 has a bottom planar surface 42, two ends 44, 46 and an open interior 47. The two ends of the raceway 14, as best shown in FIGS. 2 and 3, each have tabs 48, 50, 52, 54 respectively extending therefrom to facilitate fastening of the raceway ends 44, 46 to the end portions 16, 18. The tabs 48, 50, 52, 54 are suitably attached by way of rivets, screws 56 or other suitable conventional fastening means. Although the raceway 14 and end portions 16, 18 are depicted as separate components fastened together, it is recognized that they could be fabricated as a single integral component.

As best shown in FIG. 3, the shroud 12 has opposite parallel edge portions 58, 60. Each edge portion 58, 60 has L-shaped portions 62, 64. The L-shaped portions have a lower horizontal engagement surface 66, 68 suitable for placement of the fixture 10 on a ceiling grid, as discussed below with reference to FIG. 5. The perspective view of FIG. 3 shows the shroud 12 with the modified elliptical shape having a downwardly inverted apical crease 72. The apical crease 72 provides additional structure to the shroud for structural strength. The apical crease 72 separates the shroud 12 into two side portions 69, 70 and also creates a double elliptical shape with two focal points extending the length of the shroud. The lamps 22, 24 are generally positioned along said focal points. Such positioning provides efficient focusing of the light from the fixture. This can be especially advantageous in applications such as retail stores where there are aisles of merchandise and it is desired to primarily illuminate the aisles and merchandise and only secondarily illuminate the tops of the store fixtures holding the merchandise. The shroud 12 has a mirror-like or specular reflective inside surface 73.

The shroud 12 may be fabricated from conventional materials such as steel, aluminum, plastic, or fiberglass. The applicant has found that zinc-coated sheet steel is appropriate for forming the shroud 12. The infrastructural support provided the raceway 14 in conjunction with the opposing end portions 16, 18 allows the shroud to be constructed of a weaker, more flimsy sheet material than the housing in conventional fixtures where the housing provides the principle structural support for the fixtures.

Referring to FIGS. 3 and 4, the end portions or panels 16, 18 are shown in perspective and from an inside view. The end portions 16, 18 each have inside surfaces 76 and an outside surface 78. The raceway 14 and tube connectors 30, 32, 34, 36, 38, 40 are mounted on the inside surface 76 of the end portions 16, 18. The end portions 16, 18 each have an upper portion 80 and an inwardly offset lower portion 82 so that the fixture 10 can be accommodated by standard four foot grids and also allowing the connectors 30, 32, 34, 36, 38, 40 to be mounted on the inside surface of the end portions 16, 18. The end portions 16, 18 each have a lower edge 84 and an upper edge portion 86 which has the modified elliptical shape of the shroud 12. The upper edge portion 86 includes a lip 90 which engages with ends 91, 92 of the shroud 12. The upper edge portion 86 also has an inverted apex 93. The shroud ends 91, 92 may be conveniently attached to the inside 94 or outside 95 of the lip 90 by rivets, screws, welding or other conventional fastening means. The end portions 16, 18 may be formed of steel, aluminum or other rigid materials by conventional fabrication means.

The cross-sectional of FIG. 4 reveals the ballast 96 which provides the high frequency power to the fluorescent tubes by way of conventional wiring, not shown. The ballast 96 may be located in any suitable place within the raceway 14 and may be appropriately secured in place by way of rivets, adhesives, or other suitable means. An appropriate ballast 96 for the three bulb fluorescent embodiment is the Motorola Model #M2-IN-T8-277 available from Motorola Lighting, 887 Deerfield Parkway, Buffalo Grove, Ill., 60089.

Figure 6:
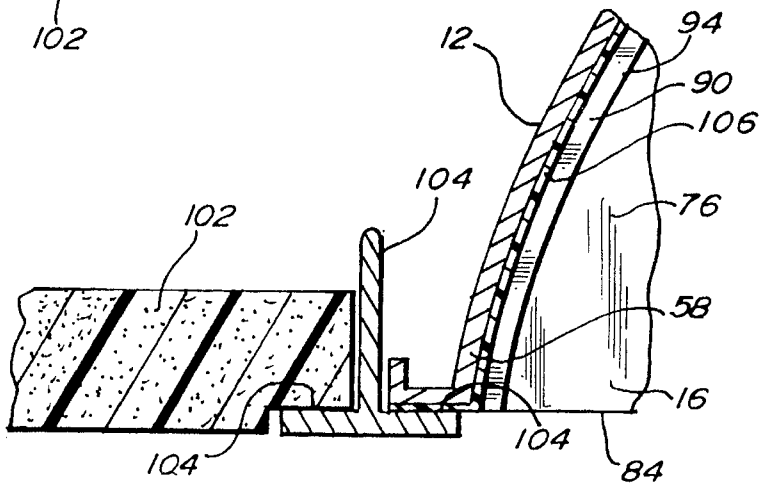
FIG. 6 shows a sectional view of the apparatus taken at line 6—6 of FIG. 5.

The edge portions 58, 60, as depicted in FIG. 4, are shown as V-shaped as an alternate to the J-shape as shown in FIG. 6. Notably, the end portions 16, 18 would typically be formed of a more rigid material than the shroud 10. Thus the bottom edges 84 of the end portions 16, 18 may support the majority or all of the weight of the fixture 10 when installed in a ceiling grid. This can be significant where the shroud 10 is fabricated of a somewhat flimsy material.

Figure 5:
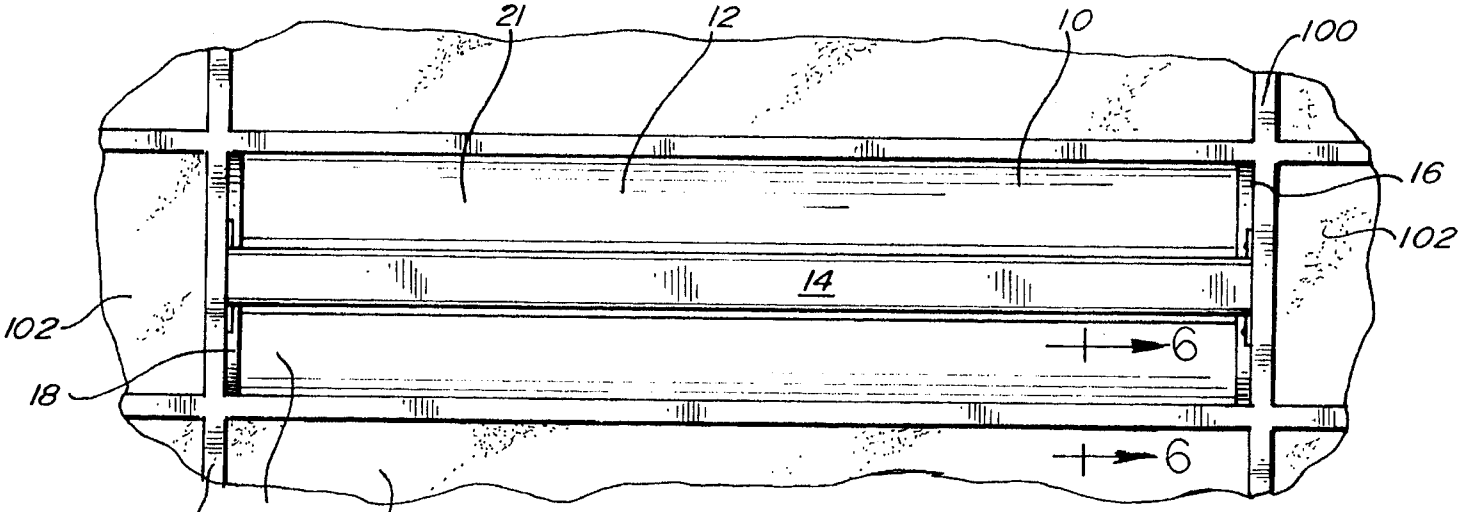
FIG. 5 shows a bottom plan view of the apparatus in a ceiling gridwork.

Referring to FIGS. 5 and 6, the light fixture 10 is shown in a bottom plan view in place in a conventional ceiling grid 100. The ceiling grid 100 supports the fluorescent fixture 10 and also acoustic panels 102. The grid is formed of a plurality of T-bars 104, a cross-section of one is shown in FIG. 6. The acoustic panels 102 rest on the upwardly facing surface 104 of the T-bar as does the fixture. The edge portion 58, 60 of the fixture is shown as J-shaped, however, it should be recognized that other shapes may also be suitable.

Referring specifically to FIG. 6, the reflective surface 73 of the shroud is shown provided by way of the use of a specular laminate 106. An appropriate laminate 106 is the Silverluxhigh performance reflective film. Such laminates may be attached to the shroud by way of the adhesive backing on the material. The Silverlux™ material is available from 3M Construction Markets Dept., 3130 Lexington Avenue South, Eagan, Minn. Alternate conventional reflective surfaces also may be used such as polished steel or aluminum or painted on reflective surfaces.

The preferred embodiment described utilizes fluorescent tubes. It should be recognized that other illuminated tubes such as neon, halogen or similar lamps may also be suitably utilized in the invention.

Moreover, although the preferred embodiment has an open bottom, it is acknowledged that other embodiments of the invention may incorporate a transparent or translucent panel or louvers covering the open bottom.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. An overhead light fixture comprising:

a) an upper elongate shroud having opposing side portions, two ends, an inwardly and downwardly facing reflective surface, the opposing side portions defining an open interior, and an inverted apical crease extending longitudinally down the shroud between the two side portions, the shroud having a modified elliptical cross-sectional shape;

b) a pair of opposing end portions, the opposing end portions each having a lower edge, the end portions rigidly connected to the two ends of the shroud;

c) an elongate rigid raceway, the raceway extending lengthwise through the open interior and connecting to the opposing end portions whereby the raceway provides an infrastructure for the fixture; and d) an elongate first illuminated tube extending between the end portions, the tube positioned under the shroud and between the raceway and the shroud.

2. The light fixture of claim 1, wherein the end portions have a modified elliptical shape with an inverted apex.

3. The light fixture of claim 2, wherein the end portions each have an upper edge portion, whereby the lower edges of the end portions are straight and parallel and the upper edge portions each have a lip that is engaged with the ends of the shroud.

4. The light fixture of claim 1, wherein the interior reflective surface of the shroud is comprised of a laminated reflective film.

5. An overhead light fixture comprising:

a) an upper elongate shroud having opposing side portions, two ends, and an inwardly and downwardly facing reflective surface, the opposing side portions defining an open interior;

b) a pair of opposing end portions, the end portions rigidly connected to the two ends of the shroud, the end portions each having a lower edge and an upper edge portion, the lower edges of the end portions straight and parallel and the upper edge portions having a modified elliptical shape with an inverted apex;

c) an elongate rigid raceway, the raceway extending lengthwise through the open interior and connecting to the opposing end portions whereby the raceway provides an infrastructure for the fixture; and d) an elongate first illuminated tube extending between the end portions, the tube positioned under the shroud and between the raceway and the shroud.

6. An overhead light fixture comprising:

a) an upper elongate shroud having opposing side portions, two ends, and an inwardly and downwardly facing reflective surface, the opposing side portions defining an open interior, each side portion having a lower edge portion;

b) a pair of opposing end portions, the opposing end portions each having a lower edge, the end portions rigidly connected to the two ends of the shroud, the lower edges and the lower edge portions of the side portions having a rectangular shape suitable for placement within a suspended ceiling grid;

c) an elongate rigid raceway, the raceway extending lengthwise through the open interior and connecting to the opposing end portions whereby the raceway provides an infrastructure for the fixture; and d) an elongate first illuminated tube extending between the end portions, the tube positioned under the shroud and between the raceway and the shroud.

7. A fluorescent light fixture comprising:

a) an elongate rigid central raceway, the raceway having an open interior and two ends;

b) a pair of opposing end panels, the opposing end panels each having a substantially straight lower edge, an upper edge portion having a modified elliptical shape, the end panels rigidly attached to the two ends of the raceway in proximity to the lower edges of the end panels;

c) a shroud portion extending between and supported by the end panels along the upper edge portions of the end panels, the shroud having an interior reflective surface; and d) a first fluorescent lamp extending between the end panels and positioned above the raceway and below the shroud.

8. The light fixture of claim 7, wherein the shroud has a pair of opposing and parallel lower edge portions, the lower edge portions and the lower edges of the end panels having a rectangular shape suitable for placement in a ceiling grid.

9. The light fixture of claim 7, wherein the interior reflective surface is comprised of a specular reflective lamination.

10. The light fixture of claim 7, wherein the end panels each have an inverted apex on the upper edges and the fixture comprises a second fluorescent lamp, the two fluorescent lamps positioned adjacent and parallel to each other above the raceway.

11. The light fixture of claim 10 further comprising a third fluorescent lamp centrally positioned directly above the raceway and equidistant from the first and second fluorescent lamps.

12. The light fixture of claim 7, wherein the shroud is formed from a rigid sheet material and also comprises an exterior housing for the fixture.

13. The ceiling light fixture of claim 10, wherein the fixture further comprises a second fluorescent lamp and a third fluorescent lamp and a ballast for providing power to the lamps, the second and third fluorescent lamps positioned above the raceway, and the ballast positioned in the raceway.

14. A ceiling light fixture comprising:

a) an inverted elongate trough-shaped shroud formed of a sheet material having an open interior, the shroud having inverted apical crease and two opposing side portions joined at said apical crease, whereby the shroud has a double elliptical shaped cross section, and further having a reflective specular downwardly and interiorly facing surface, opposing parallel side edge portions, and two ends, the shroud forming an exterior housing for the fixture;

b) an elongate rigid infrastructure extending lengthwise through the shroud intermediate the parallel side edge portions, the infrastructure having two ends;

c) a pair of opposing end panels, each end panel attached to an end of the infrastructure and an end of the shroud, each end panel having lower edge portions substantially coplanar and normal to the side edge portions of the shroud; and d) a first illuminated lamp extending lengthwise above the rigid infrastructure and under the shroud.

15. The ceiling light fixture of claim 14 further comprising a ballast positioned in the infrastructure.

* * * * *

UNITED STATES PATENT AND TRADEMARK OFFICE

CERTIFICATE OF CORRECTION

PATENT NO. : 5,570,947

DATED : November 5, 1996

INVENTOR(S) : Garold M. Felland

It is certified that error appears in the above-indentified patent and that said Letters Patent is hereby corrected as shown below:

Column 4, line 46, please delete the word "Silverluxhigh" and insert in its place --Silverlux™ high--.

Signed and Sealed this

Eleventh Day of March, 1997

*Attest:*

*Attesting Officer*

BRUCE LEHMAN

*Commissioner of Patents and Trademarks*